United States Patent [19]

Dotson et al.

[11] 4,177,115

[45] Dec. 4, 1979

[54] ELECTROCHEMICAL PRODUCTION OF ORGANIC HYPOHALITE COMPOUNDS IN AN UNDIVIDED CELL

[75] Inventors: Ronald L. Dotson, Cleveland; Richard W. Lynch, Chattanooga, both of Tenn.

[73] Assignee: Olin Corporation, New Haven, Conn.

[21] Appl. No.: 937,223

[22] Filed: Aug. 28, 1978

[51] Int. Cl.[2] ..... C25B 3/02

[52] U.S. Cl. ..... 204/78; 204/79

[58] Field of Search ..... 204/72, 78–81

[56] References Cited

U.S. PATENT DOCUMENTS

| | | | |
|---|---|---|---|
| 3,288,692 | 11/1966 | Leduc | 204/80 |
| 3,449,225 | 6/1969 | Matzner et al. | 204/81 |
| 3,632,498 | 1/1972 | Beer | 204/290 F |
| 4,008,133 | 2/1977 | Gelbein et al. | 204/80 |
| 4,451,905 | 6/1969 | Kronig et al. | 204/80 |

*Primary Examiner*—F. C. Edmundson

*Attorney, Agent, or Firm*—Gordon F. Sieckmann; Donald F. Clements

[57] ABSTRACT

An electrolytic process is described for preparing organic hypohalite compounds from an electrolyte comprised of aqueous brine, organic alcohol, and organic solvent solution in an undivided cell. For example, tertiary butyl hypochlorite is prepared in an undivided cell by the electrolysis of tertiary butyl alcohol and aqueous sodium chloride brine. High product yield, high cell current efficiency, and high cell current density are achieved by proper selection and use of a suitable inert organic solvent in the cell during electrolysis, proper selection of anode to cathode gap distance, and proper control of the pH of the electrolyte solution. The organic hypohalite formed in the cell is recovered for use after electrolysis.

40 Claims, No Drawings

ELECTROCHEMICAL PRODUCTION OF ORGANIC HYPOHALITE COMPOUNDS IN AN UNDIVIDED CELL

The present invention relates to an improved electrolytic process for preparing organic hypohalites from a solution of an aqueous brine and an organic alcohol in an undivided cell.

The prior art teaches the use of organic hypohalites as halofunctionalization agents, e.g., an agent which gives a halogen in a +1 valence state, in the manufacture of propylene oxide, calcium hypochlorite and other industrial chemicals. Although organic hypohalites may be produced by prior art chemical and electrolytic processes, certain problems with respect to safety, economics, pollution, and purity in these processes demonstrate the need for an improved process.

For example, U.S. Pat. No. 2,694,722, issued Nov. 16, 1954 to Irving Katz, discloses a chemical process for preparing alkyl hypochlorites which comprises dissolving an inorganic hypochlorite salt such as sodium hypochlorite and an organic alcohol such as tertiary butyl alcohol in water and then adding carbon dioxide as shown by equation (1):

$$NaOCl + CO_2 + (CH_3)_3COH \rightarrow (CH_3)_3COCl + NaHCO_3. \quad (1)$$

Another example, U.S. Pat. No. 1,938,175, issued Dec. 5, 1933 to Richard M. Deanesly, discloses a chemical process for preparing alkyl hypochlorites according to the following equations:

$$NaOH + C_4H_9OH + Cl_2 \rightarrow C_4H_9OCl + NaCl + H_2O \quad (2)$$

$$KOH + R_aOH + Cl_2 \rightarrow R_aOCL + KCl + H_2O \quad (3)$$

where $R_aOH$ is any aliphatic alcohol of primary, secondary, or tertiary character.

In *Encyclopedia of Chemical Technology,* by Kirk-Othmer, 2nd edition, volume 5, pages 24–25, a variety of chemical processes are employed for preparing organic hypochlorites. Reference is made to solutions prepared with carbon tetrachloride, chloroform, or o-dichlorobenzene.

In another example, U.S. Pat. No. 3,449,225, issued to Edwin A. Matzner on June 10, 1969, an electrolytic process is disclosed for preparing organic hypohalites from inorganic halides and organic compounds in an undivided cell. The patent discloses that a mixture of a brine solution and an organic alcohol, such as tertiary butyl alcohol, is charged to an undivided cell containing five pairs of equally spaced circular electrodes of about 1.0 centimeter diameter. However, in the disclosed example, extremely low temperatures were used as the cell temperature was maintained at about 2° C.±1° C. Hydrochloric acid was added to the cell during electrolysis to consume excess NaOH and to maintain the pH of the solution at about 8 to about 9. After electrolysis, the pH of the solution was adjusted to about 7. Current density was about 0.1 ampere per square centimeter at a voltage of about 5.4 volts.

There is a need at the present time for an improved electrolytic process for preparing organic hypohalites which have high cell current efficiency, high product yield, and high cell current density.

OBJECTS

It is a primary object of this invention to provide an improved electrolytic process for preparing organic hypohalites.

A further object is to provide an improved electrolytic process for preparing organic hypohalites wherein problems in the areas of safety, economics, pollution, and product purity are greatly reduced.

Still another object of this invention is to provide an improved electrolytic process for preparing tertiary butyl hypochlorite wherein problems in the areas of safety, economics, pollution, and product purity are greatly reduced.

A further object of this invention is to provide an improved electrolytic process for preparing tertiary butyl hypochlorite having high cell current efficiency, high product yield, and high cell current density.

A further object of this invention is to provide an improved electrolytic process for preparing tertiary butyl hypochlorite with minimum solvent usage.

These and other objects of the invention will become apparent from the following description and the appended claims.

BRIEF DESCRIPTION OF THE INVENTION

The foregoing objects of the invention are accomplished in the process of this invention, utilizing an electrolytic cell having an electrolytic chamber containing therein an anode and a cathode separated by a gap distance.

In carrying out the process of this invention, an electrolyte comprised of a mixture of a halide-containing brine and organic alcohol in an organic solvent is charged into the electrolytic chamber.

A direct current is supplied to the cell and a voltage is impressed across the anode and cathode, whereby organic hypohalite is formed by electrolysis of the electrolyte.

The organic hypohalite is recovered from the electrolytic chamber.

DESCRIPTION OF THE INVENTION

The electrolytic cell, without separator between electrodes, hereinafter called the "gap cell", employed in this invention may be a commercially available or a custom built electrolytic cell of a size and electrical capacity capable of economically producing the desired organic hypohalite product.

A particularly advantageous electrolytic cell which may be employed in the practice of this process has an electrolytic chamber containing therein an anode and a cathode separated by a specific gap distance. The process of this invention comprises charging an electrolyte comprised of a halide-containing brine, organic alcohol, and an organic solvent into the electrolytic chamber, passing a direct current between the anode and cathode, whereby organic alcohol reacts with the halide to form the corresponding organic hypohalite in an electrochemical reaction and recovering the organic hypohalite from the electrolytic chamber.

The term "electrolyte" is used throughout the claims and description to define the mixture of brine and organic alcohol in the organic solvent employed in the gap cell.

Examples of materials which may be employed as an anode include commercially available platinized titanium, platinized tantalum, or platinized platinum electrodes which contain, at least on the surface of the electrodes, a deposit of platinum on titanium, platinum on tantalum, or platinum on platinum. Also effective are anodes composed of graphite, or anodes composed of a metal oxide coated substrate such as described in U.S. Pat. No. 3,632,498, issued to H. B. Beer on Jan. 4, 1972. When such electrodes are employed as anodes, anodic chlorine overvoltage is minimized. One skilled in the art will recognize, however, that any anode construction capable of effecting electrolytic production of organic hypohalite from a brine containing an organic alcohol may be used in the process of this invention.

Examples of materials which may be employed as the cathode are carbon steel, stainless steel, nickel, nickel molybdenum alloys, nickel vanadium alloys and others. Those skilled in the art will recognize that any cathode material that is capable of effecting the electrolytic reduction of water and having surfaces with either high or low hydrogen overvoltage may be used as cathode construction material in the process of this invention.

The distance between the anode and the cathode is known as the gap distance.

At least one anode and one cathode is positioned within the electrolytic chamber. For maximum exposure of the electrolytic surface, the face of the anode should be parallel to the face of the cathode.

In one embodiment of the process of this invention, the cell anode is a circular titanium rod substrate, coated with a mixed oxide of titanium and ruthenium. The coating is obtained by painting the titanium substrate with butyl titanate and ruthenium trichloride then oven fired to form the metal oxides.

In the same embodiment, the cell cathode is a flat section of plate nickel which is bent into a semicircular shape paired parallel to the circular anode such that one-half the circumference of the anode is directly opposite and equidistant to the semicircular shaped cathode. As a result of this pairing, a uniform gap distance is created between the anode and the cathode at all points facing one another.

If desired, for this embodiment, the anode to caathode gap distance may be varied. However, it may then be necessary to increase or decrease the cathode width if it is desired to also maintain the positioning described above.

The cathode and anode may each be of either solid, felt, mesh, foraminous, packed bed, expanded metal, or other design. Those skilled in the art will recognize that any electrode configuration or design capable of effecting the electrolytic production of organic hypohalite from a brine containing an organic alcohol or cathodic production of alkali metal hydroxide may be used in the process of this invention.

Also, those skilled in the art will recognize that any geometric anode-cathode pairing arrangement capable of effecting the electrolytic production of organic hypohalite from a brine containing an organic alcohol or cathodic production of alkali metal hydroxide may be used in the process of this invention. It is not a requirement of the process of this invention that the anode to cathode gap distance be a uniform distance at all points.

Halogenated organic compounds containing halogen atoms such as chlorine and bromine in a +1 oxidation state, bonded to oxygen atoms, may be prepared in accordance with the process of this invention. The analogous organic hypohalite compounds containing iodine and fluorine tend to be more unstable than corresponding compounds containing chlorine or bromine and it has been found generally advantageous to prepare organic compounds containing chlorine, bromine and mixtures thereof.

The electrolyte is comprised of an aqueous mixture of brine and an organic alcohol. The brine employed may be an aqueous solution of an alkali metal halide selected from the group consisting of sodium chloride, sodium bromide, potassium chloride, potassium bromide, or mixtures thereof. For reasons previously described, it is desired to prepare organic compounds containing chlorine, bromine and mixtures thereof. Preferably sodium chloride is employed as the brine. When employing sodium chloride, the concentration of sodium chloride in the brine ranges from about 175 grams per liter to about 327 grams per liter and preferably, from about 250 to about 320 grams per liter of sodium chloride.

Any organic alcohol capable of being electrolytically transformed into the corresponding organic hypohalite in a gap cell may be utilized in the process of this invention. Useful organic alcohols are selected from the group consisting of secondary alcohols, tertiary alcohols, cyclic alcohols, and mixtures thereof.

Examples of alcohols which may be employed as hypohalite carriers in this process are secondary alcohols of the form,

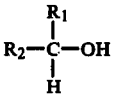

where $R_1$ and $R_2$ are each selected from a group consisting of alkyl or aryl groups having 1 to about 10 carbon atoms each. Examples of secondary alcohols are 2-propanol, 2-butanol, 2-pentanol, 3-pentanol, 2-methyl-3-butanol, 3-hexanol, 2-hexanol, 2-methyl-3-pentanol, 3-methyl-2-pentanol, 2-methyl-4-pentanol, 2,2-dimethyl-3-butanol, 2-heptanol, 3-heptanol, 4-heptanol, 2-methyl-3-hexanol, 2-methyl-4-hexanol, 2-methyl-5-hexanol, 2,2-dimethyl-3-pentanol, 2,2-dimethyl-4-pentanol, 3,3-dimethyl-2-pentanol, 2,4-dimethyl-3-pentanol, 2,3-dimethyl-4-pentanol, 3-ethyl-2-pentanol, 2-octanol, 2-nonanol, 2-decanol, 4-decanol, Other alcohols employed may be a tertiary diol of the form,

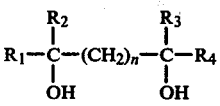

where n is an integer from 1 to about 10 and $R_1$, $R_2$, $R_3$, and $R_4$ are each selected from a group consisting of alkyl or aryl groups having 1 to about 10 carbon atoms each. Tertiary diols of this type are 2,5-dimethyl-2,5-hexanediol, 2,4-dimethyl-2,4-pentanediol, 2,4-dimethyl-2,4-hexanediol, and 2-methyl-4-ethyl-2,4-hexanediol.

Other examples of alcohols which may be used in this process are tertiary alcohols of the form,

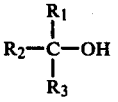

where $R_1$, $R_2$, and $R_3$ are each selected from a group consisting of alkyl or aryl groups having 1 to about 10 carbon atoms each. Tertiary alcohols of this type are 2-methyl-2-propanol (tertiary butyl alcohol), 2-methyl-2-butanol (tertiary amyl alcohol), 3-methyl-3-pentanol, 2-methyl-2-pentanol, 3-ethyl-3-pentanol, 3-iopropyl-3-pentanol, 2,3-dimethyl-3-pentanol, 2,3-dimethyl-2-pentanol, 3-ethyl-3-octanol, 5-butyl-5-nonanol, 3,7-dimethyl-3-octanol, 2-methyl-2-octanol, 4-ethyl-4-heptanol, 2-methyl-2-heptanol, 3-methyl-3-heptanol, 4-methyl-4-heptanol, 4-propyl-4-heptanol, 3-ethyl-3-hexanol, 3-ethyl-5-methyl-3-hexanol, 2-methyl-2-hexanol, 3-methyl-3-hexanol, 2,3,5-trimethyl-2-hexanol, 2,3,4-trimethyl-2-hexanol, 2,2,3-trimethyl-3-hexanol, 2,3,5-trimethyl-3-hexanol, 3,4,4-trimethyl-3-hexanol, 3,5,5-trimethyl-3-hexanol, 2,4-dimethyl-2-pentanol, 3-ethyl-2-methyl-3-pentanol, 2-phenyl-2-pentanol, 3-phenyl-3-pentanol, 2,4,4-trimethyl-2-pentanol, 2,3-dimethyl-2-butanol, 2,3,3-trimethyl-2-butanol, and triphenylmethanol.

Other alcohols which may be used in the process of this invention are cyclohexanol and related cyclic alcohols.

To simplify the description, the invention will be defined in terms of organic alcohol, but one skilled in the art will recognize that the term "organic alcohol" also includes mixtures of organic alcohols.

As used throughout the description and claims, the term "alkyl" is intended to include straight chain, cyclic, substituted straight chain and substituted cyclic alkyl groups. As used throughout the description and claims, the term "aryl" is intended to include normal and substituted aromatic groups. The particular water soluble alkali metal halide employed and the particular organic alcohol employed will depend upon the organic hypohalite which it is desired to be prepared. Thus, for example, when it is desired to prepare tertiary butyl hypochlorite, then sodium chloride brine and tertiary butyl alcohol are employed as the electrolyte.

The molar ratio of alkali metal halide to organic alcohol in the electrolyte employed in the operation of the gap cell ranges from about 2:1 to about 20:1 and preferably from about 3:1 to about 10:1.

In operation of the process of this invention, direct current is supplied to the cell and a voltage is impressed across the cell terminals.

The operating temperature of the gap cell is in the range of about −10° C. to about 80° C., preferably in the range of about −5° C. to about 40° C. The temperature may vary in the range noted above, from just above the freezing point of the electrolyte to about 80° C., depending in part on factors such as the organic alcohol employed, the solubility and concentration of the brine in the aqueous anolyte, ionic strength, and the electrical conductivity of the electrolyte. When the temperature of the aqueous electrolyte falls or is permitted to fall near the freezing temperature, little, if any halogenated organic compound will be formed because of suppessed ionic mobilities and the substantial resistance to the passage of electric current due to freezing of the electrolyte solution or crystallization of alkali metal halide from the brine. On the other hand, if the temperature of the electrolyte rises or is permitted to rise above about 80° C., substantial undesirable side reactions, including product decomposition often occur resulting in lower product yield.

The operating pressure of the cell is essentially atmospheric. However, sub- or superatmospheric pressures may be used, if desired.

For the process of this invention, the current efficiency for the cell is defined as output over input or the ratio of the number of chemical equivalents of product formed divided by the electrical equivalents consumed in forming that product × 100. This may be expressed mathematically by the following equation:

$$\% \text{ Current Efficiency} = \frac{A/B}{C/D} \times 100$$

where

A = Mass of product produced in grams.

B = Equivalent weight of product produced in grams per equivalent.

C = Quantity of electricity consumed in making desired product in ampere hours.

D = Faraday's Constant i.e. 26.81 ampere hours per equivalent.

It has been unexpectedly found that when a suitable organic solvent, other than the precursor organic alcohol is present with the brine and organic alcohol during electrolysis, the cell current efficiency increases dramatically. For example, the cell current efficiency for preparing tertiary butyl hypochlorite using tertiary butyl alcohol and aqueous sodium chloride brine, was found to be about 27% without organic solvent. When using an organic solvent, such as carbon tetrachloride, the cell current efficiency increased to about 95%.

In order to achieve the improved current efficiency in the practice of the process of this invention, it is essential to employ an organic solvent in the electrolyte. During electrolysis, the organic solvent is preferably circulated as a part of the electrolyte through the gap cell electrolytic chamber and an external electrolyte storage vessel.

The organic solvent used in this invention may be an essentially inert liquid essentially immiscible with the aqueous phase of the electrolyte. The organic solvent extracts from the electrolyte the organic hypohalite product and significant quantities of any unreacted organic alcohol, while the remainder of the unreacted organic alcohol and a minor amount of the organic hypohalite product will be contained in the aqueous brine.

The organic solvent may be admixed with the halide-containing brine and organic alcohol before or after addition to the electrolytic chambers.

The proportion of solvent will vary with the nature of the solvent and the organic hypohalite, but sufficient solvent is present at all times to extract the maximum proportion of organic hypohalite from the aqueous brine.

The weight ratio of organic solvent employed to organic alcohol is in the range from about 5:1 to about 1:1, and preferably in the range from about 3:1 to about 1.2:1.

Suitable solvents include a wide variety of halogenated hydrocarbons and organic phosphate compounds. A typical family of halogenated hydrocarbon solvents are those represented by the formula $$CH_xCl_y$$

where $x+y=4$ and y is an integer from 2 to 4.

Examples of suitable members of this family of solvents include $CCl_4$, $CHCl_3$, and $CH_2Cl_2$.

After electrolysis, the electrolyte containing organic hypohalite is phased separated from halide-containing brine. The electrolyte is conveyed to a phase separator, where the electrolyte is separated into an organic layer which contains the organic hypohalite, organic alcohol, organic solvent, and an aqueous layer which contains mainly depleted brine and organic alcohol. The organic phase containing organic hypohalite is collected and stored for use as previously described. The aqueous phase is reconstituted in water and alkali metal halide to replenish that used in electrolysis and is recycled to the electrolytic chamber of the gap cell either separately or mixed with depleted organic layer which contains organic solvent and organic alcohol.

The organic solvent may be separated from the organic hypohalite and organic solvent by conventional means, for example, solvent extraction, and recycled to the electroylytic chamber.

Another example of an organic solvent is an organic phosphate of the formula

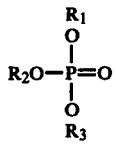

where $R_1$, $R_2$, and $R_3$ are each a separate alkyl or aryl group, for example, methyl, ethyl, n-butyl, isopropyl, n-pentyl, isobutyl, n-propyl, phenyl, 2-tolyl, 3-tolyl, or 4-tolyl. In general, each separate alkyl or aryl group will have 1 to about 10 carbon atoms. Organic phosphates of this type are tri-methyl phosphate, tri-ethyl phosphate, tri-n-butyl phosphate, tri-n-propyl phosphate, tri-isopropyl phosphate, tri-n-pentyl phosphate, tri-isobutyl phosphate, tri-phenyl phosphate, tri-2-tolyl phosphate, tri-3-tolyl phosphate, and tri-4-tolyl phosphate.

Another example of a suitable organic solvent family is of the formula $$C_2F_xCl_y$$

where y is an integer from 2 to 6 and $x+y=6$.

Examples of this family include 1,1,1-trichloro-2,2,2-trifluoroethane, 1,1,2-trichloro-1,2,2-trifluoroethane, 1,1-dichloro-1,2,2,2-tetrafluoroethane, hexachloroethane, and fluoropentachloroethane.

Another example of a suitable family of organic solvents is of the formula $$C_2H_xCl_y$$

where y is an integer from 1 to 6 and $x+y=6$.

Examples of this family include 1,2-dichloroethane, 1,1,1-trichloroethane, 1,1,2-trichloroethane, 1,1,1,2-tetrachloroethane, 1,1,2,2-tetrachloroethane, and pentachloroethane.

Another example of a suitable family of organic solvents is of the formula $$C_2H_xF_y$$

where y is an integer from 1 to 2 and $x+y=6$. Examples are 1,2-difluoroethane, 1,1-difluoroethane, and fluoroethane.

Another example of a suitable family of organic solvents is of the formula $$C_3H_xCl_y$$

where y is an integer from 1 to about 4 and $x+y=8$.

Examples of this family include isopropyl chloride, 1,2-dichloropropane, 1,1,1,2-tetrachloropropane, and 1,1,2,2-tetrachloropropane.

Another example of a suitable family of organic solvents is a tertiary halide of the formula

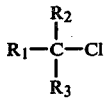

where $R_1$, $R_2$, and $R_3$ are each separate alkyl or aryl groups having from 1 to about 10 carbon atoms each. Solvents include 2-chloro-2-methylpropane, 2-chloro-2-methylbutane, 2-chloro-2-methylpentane, and 3-chloro-3-ethylpentane.

Other examples of suitable organic solvents include 2-chlorotoluene, 3-chlorotoluene, 4-chlorotoluene, and alpha-chlorotoluene.

Other solvents which may be used include chlorobenzene, 1,2-dichlorobenzene, 1,3-dichlorobenzene, 1,2,4-trichlorobenzene, and fluorobenzene.

To simplify the description, the invention will be defined in terms of "organic solvent", but one skilled in the art will recognize that the term "organic solvent" also includes the various possible mixtures of organic solvents.

The gap cell can be operated on a batch or flow-through system. In the latter system, the electrolyte is continuously circulated to and from an external electrolyte storage vessel. In addition, at least a portion of the electrolyte containing organic hypohalite is separated from the electrolytic chamber and external electrolyte storage vessel.

In operation of the process of this invention, direct current is supplied to the cell and electrical pressure in the form of a voltage is impressed across the electrodes from anode to cathode.

For example, when employing sodium chloride brine and tertiary butyl alcohol to prepare tertiary butyl hypochlorite, the tertiary butyl hypochlorite is formed in the vicinity of the anode. Sodium ions join with hydroxyl ions produced in the vicinity of the cathode by the hydrolysis of water to produce sodium hydroxide. The pH of the electrolyte is maintained at the desired value by addition of a suitable acid, for example, hydrochloric acid at regular intervals.

Nitrogen is purged through the top of the cell to dilute and remove any hydrogen and chlorine gas generated by electrolysis.

It has been found that the cell current efficiency as previously defined is a function of the anode to cathode gap distance.

For example, when preparing tertiary butyl hypochlorite from tertiary butyl alcohol and aqueous sodium chloride, with an electrolyte pH of about 7.5, it has been found that the cell current efficiency is markedly increased whenever the anode to cathode gap distance is in the range of about 0.05 centimeter to about 2.5 centimeters, preferably in the range from about 0.10 centimeter to about 1.25 centimeters, and more preferably in the range from about 0.15 centimeter to about 0.30 centimeter.

Essentially the same distances are also useful in optimizing cell current efficiency for other organic alcohols and other alkali metal halide brines.

It has also been found that the cell current efficiency is markedly effected by a combination of gap distance and pH of the electrolyte. For example, when the anode to cathode gap distances greater than about 0.30 centimeter are employed, it is advantageous to maintain the pH of the electrolyte in the range from about 5.0 to about 8.5.

When the anode to cathode gap distances which are about 0.30 centimeter or less are employed, it is advantageous to maintain the pH of the electrolyte in the range from about 4 to about 10, preferably in the range from about 5.0 to about 8.5.

The pH of the electrolyte can be adjusted to the aforesaid ranges by periodic addition of acid, for example, by adding appropriate amounts of hydrochloric acid to the electrolyte solution during electrolysis.

High cell current efficiency, current density, and product yield are achieved by use of organic solvent, selection of anode to cathode gap distance and pH of the electrolyte.

The following examples are presented to define the invention more fully without any intention of being limited thereby. All parts and percentages are by weight unless indicated otherwise.

EXAMPLE 1

Tertiary butyl hypochlorite was prepared batchwise in an undivided gap cell constructed from a 2500 milliliter cylindrical glass container about 12.70 centimeters in diameter and about 30.5 centimeters in height.

The cell anode was about 0.80 centimeter diameter circular titanium rod substrate, coated with a mixed oxide of titanium and ruthenium. The coating was obtained by painting the titanium substrate with butyl titanate and ruthenium trichloride and then oven fired to form the metal oxides. The finished anode was of the type described in U.S. Pat. No. 3,632,498, issued to H. B. Beer on Jan. 4, 1972.

The cell anode had an exposed length of about 7.62 centimeters, which corresponded to an anode contact area of about 19 square centimeters.

The cell cathode was a section of plate nickel haing the dimensions of 0.08 centimeter thick, 7.62 centimeters high and 2.25 centimeters wide, and a total contact flat side area of about 17 square centimeters. The cell cathode section was bent into a semicircular shape of about 1.44 centimeters in diameter and paired parallel with the circular anode such that one-half the circumference of the anode was directly opposed by the semicircular shaped cathode. As a result of this pairing, about a 0.30 centimeter gap distance was created between the anode and the cathode at all points facing one another.

The anode and cathode electrode pair was inserted into the glass container through a neck in the cylindrical glass container and fixed in a vertical position.

About 1800 parts of saturated aqueous sodium chloride brine (pH=7.5) was added to the cell, and the anode and the cathode electrode pair was completely immersed in the brine. The electrodes were connected to an adjustable direct current power supply. The brine was electrolyzed while being mechanically stirred at about 22° C., at a constant voltage of about 3.5 volts. The cell current averaged about 3.2 amperes. After one hour, electrolysis was stopped.

About 40 parts of tertiary butyl alcohol and about 525 parts of carbon tetrachloride were added to and mixed with the contents of the cell. Electrolysis was resumed at a constant voltage of 3.15 volts, an average cell current of 3.0 amperes, and at a temperature of about 25° C. Cell current density (based on total anode contact area) was about 1600 amperes per square meter. After two hours (about 6.0 ampere-hours of electrical energy used), electrolysis was stopped. The cell contents were removed from the cell to a settling zone where the cell contents physically separated into an aqueous phase and an organic phase. Analysis of the organic phase showed the presence of 11.6 parts of recovered tertiary butyl hypochlorite in the organic phase, which was equivalent to a cell current efficiency of about 95%.

For purposes of comparison, the same conditions were employed, except that no organic solvent was employed, the cell temperature was about 14° C.; cell voltage was about 3.0 volts, and cell amperage was about 2.2 amperes. The electrical energy used was about 6.4 ampere hours. Analysis of the organic phase showed the presence of about 2.4 grams of tertiary butyl hypochlorite in the organic phase. The cell current efficiency was only about 27% without solvent.

EXAMPLES 2-14

In Examples 2-15, a cell was employed as described in Example 1. The cathode material of construction was 316 stainless steel. In Examples 2-15, the brine was analyzed for sodium hypochlorite content after electrolysis for one hour before any organic alcohol and organic solvent were added. In Examples 2-14, the organic solvent employed was carbon tetrachloride. In Example 15, methylene chloride was employed as the organic solvent.

The anode to cathode gap distance ranged from about 0.15 centimeter to about 1.25 centimeters at selected distances. The anode diameter was constant at about 0.80 centimeter. The cathode height was constant at about 7.60 centimeters. Also the cathode thickness was constant at about 0.05 centimeter. The pairing of the anode and cathode was maintained as described in Example 1. The cell cathode section was bent into a semicircular shape and paired parallel with the circular anode such that one-half the circumference of the anode was directly opposed by the semicircular shaped cathode.

As the anode to cathode gap distance was increased or decreased, the width of the cathode was proportionately increased or decreased to maintain the anode to cathode pairing as described above.

| Anode to Cathode Gap Distance (Centimeters) | Cathode Width (Centimeters) |
|---|---|
| 0.16 | 1.76 |
| 0.32 | 2.25 |
| 0.48 | 2.75 |
| 0.64 | 3.26 |
| 1.27 | 5.24 |

Examples 2-6 as shown in Table I, illustrate gap cell performance at varying anode to cathode gap distances using carbon tetrachloride solvent at an electrolyte pH of about 7.5.

Examples 7-8 as shown in Table II, illustrate gap cell performance at an electrolyte pH of about 9.2, using carbon tetrachloride solvent, at gap distances ranging from about 0.16 centimeter to about 1.25 centimeters.

Examples 11-14 as shown in Table III, illustrate gap cell performance at an electrolyte pH of about 5.8, using carbon tetrachloride solvent and gap distances ranging from about 0.16 centimeter to about 1.25 centimeters.

Example 15, as shown in Table IV, illustrates gap cell performance employing methylene chloride solvent at an anode to cathode gap distance of about 0.30 centimeter and an electrolyte pH of about 7.5.

Table I

Examples of Gap Cell Performance at Varying Gap Distances With $CCl_4$ Solvent

| | | Examples | | | | |
|---|---|---|---|---|---|---|
| | | 2 | 3 | 4 | 5 | 6 |
| (1) | Gap Distance, Centimeters | 0.16 | 0.32 | 0.48 | 0.64 | 1.27 |
| (2) | Electrolyte, pH | 7.5 | 7.5 | 7.5 | 7.5 | 7.5 |
| (3) | Organic Solvent, added | $CCl_4$ | $CCl_4$ | $CCl_4$ | $CCl_4$ | $CCl_4$ |
| (4) | NaOCl in Pre-Electrolyzed Brine, grams | 3.79 | 4.21 | 3.41 | 5.02 | 3.52 |
| (5) | NaOCl in Final Brine, grams | 0.68 | 1.23 | 0.79 | 0.05 | 1.00 |
| (6) | Temperature, °C. | 23 | 22 | 26 | 27 | 23 |
| (7) | Cell Voltage, volts | 3.1 | 3.2 | 3.6 | 3.5 | 4.2 |
| (8) | Cell Amperage, amperes | 3.4 | 3.4 | 3.4 | 3.4 | 3.4 |
| (9) | Electrical Energy Used, ampere-hours | 6.6 | 6.3 | 6.8 | 6.6 | 6.8 |
| (10) | Organic Phase, milliliters | 360 | 370 | 340 | 334 | 347 |
| (11) | Tertiary Butyl Hypochlorite in Organic Phase, grams | 16.2 | 16.1 | 15.2 | 18.0 | 15.0 |
| (12) | Cell Current Efficiency, % | 86.9 | 92.2 | 86.7 | 84.6 | 82.2 |

Table II

Examples of Gap Cell Performance at Varying Gap Distance With the Electrolyte pH of About 9.2

| | | | | COMPARATIVE EXAMPLES | |
|---|---|---|---|---|---|
| | | 7 | 8 | (A) | (B) |
| (1) | Gap Distance, Centimeters | 0.16 | 0.32 | 0.64 | 1.27 |
| (2) | Electrolyte, pH | 9.2 | 9.2 | 9.2 | 9.2 |
| (3) | Organic Solvent, added | $CCl_4$ | $CCl_4$ | $CCl_4$ | $CCl_4$ |
| (4) | NaOCl in Pre-Electrolyzed Brine, grams | 4.13 | 3.91 | 4.35 | 4.48 |
| (5) | NaOCl in Final Brine, grams | 13.96 | 12.88 | 19.94 | 8.54 |
| (6) | Temperature, °C. | 25 | 25 | 26 | 26 |
| (7) | Cell Voltage, volts | 3.12 | 3.15 | 3.45 | 4.05 |
| (8) | Cell Amperage, amperes | 3.4 | 3.4 | 3.4 | 3.4 |
| (9) | Electrical Energy Used, ampere-hours | 6.5 | 6.5 | 6.4 | 6.1 |
| (10) | Organic Phase, milliliters | 367 | 370 | 365 | 351 |
| (11) | Tertiary Butyl Hypochlorite in Organic Phase, grams | 8.27 | 8.98 | 6.88 | 4.71 |
| (12) | Cell Current Efficiency, % | 78 | 82 | 12.3 | 5.7 |

Table III

Examples of Gap Cell Performance at Varying Gap Distances With the Electrolyte pH of 5.8

| | | Examples | | | |
|---|---|---|---|---|---|
| | | 11 | 12 | 13 | 14 |
| (1) | Gap Distance, Centimeters | 0.16 | 0.32 | 0.48 | 1.27 |
| (2) | Electrolyte, pH | 5.8 | 5.8 | 5.8 | 5.8 |
| (3) | Organic Solvent, added | $CCl_4$ | $CCl_4$ | $CCl_4$ | $CCl_4$ |
| (4) | NaOCl in Pre-Electrolyzed Brine, grams | 3.83 | 3.86 | 3.39 | 4.10 |
| (5) | NaOCl in Final Brine, grams | 0.10 | 0.08 | 0.30 | 0.28 |
| (6) | Temperature, °C. | 25 | 19 | 25 | 25 |
| (7) | Cell Voltage, volts | 3.13 | 3.19 | 3.4 | 4.03 |
| (8) | Cell Amperage, amperes | 3.4 | 3.4 | 3.4 | 3.4 |
| (9) | Electrical Energy Used, ampere-hours | 6.5 | 6.6 | 6.6 | 6.6 |
| (10) | Organic Phase, milliliters | 368 | 367 | 355 | 350 |
| (11) | Tertiary Butyl Hypochlorite in Organic Phase, grams | 16.76 | 17.47 | 15.7 | 16.57 |
| (12) | Cell Current Efficiency, % | 84.3 | 89.6 | 83.9 | 78.2 |

Table IV

Example of Gap Cell Performance Using Methylene Chloride Solvent

| | | Example 15 |
|---|---|---|
| (1) | Gap Distance, Centimeters | 0.32 |
| (2) | Electrolyte, pH | 7.5 |
| (3) | Organic Solvent, added | Methylene Chloride |
| (4) | NaOCl in Pre-Electrolyzed Brine, grams | 4.27 |
| (5) | NaOCl in Final Brine, grams | 1.73 |
| (6) | Temperature, °C. | 21 |
| (7) | Cell Voltage, volts | 3.33 |
| (8) | Cell Amperage, amperes | 3.4 |
| (9) | Electrical Energy Used, ampere-hours | 6.4 |
| (10) | Organic Phase, milliliters | 330 |
| (11) | Tertiary Butyl Hypochlorite in Organic Phase, grams | 15.4 |
| (12) | Cell Current Efficiency, % | 90 |

The effective use of organic solvent, selection of anode to cathode gap distance and pH of the electrolyte are reflected in the calculated gap cell current efficiency as shown in Tables I, II, III and IV. In Examples 2–6 using carbon tetrachloride solvent, an electrolyte pH of about 7.5, as the anode-cathode gap distance was increased from about 0.16 centimeter to about 0.32 centimeter, cell current efficiency increased from about 87 percent to about 92 percent. However, as the anode to cathode gap distance was further increased from about 0.32 centimeter to about 1.27 centimeters, the cell current efficiency decreased from about 92 percent to about 82 percent.

Table II shows in Examples 7 and 8 that for a gap distance ranging from 0.16 to 0.32 centimeter and pH of the electrolyte was maintained at about 9.2, the cell current efficiency ranged from about 78 percent to about 82 percent. Comparative Tests A and B in Table II show that when the gap distance was increased to the range from 0.64 to 1.27 centimeters, at a pH of 9.2, the cell efficiency markedly decreased to a range of from about 5.7 to 12.3 percent.

Table III shows that when using carbon tetrachloride solvent and anode to cathode gap distances from about 0.16 centimeter to about 1.27 centimeters, and the pH of the electrolyte was maintained at about 5.8, the calculated cell current efficiency ranged from about 78.2 percent to about 89.6 percent.

Table IV shows use of methylene chloride as the organic solvent at a pH of about 7.5 and an anode to cathode gap distance of 0.32 centimeter.

High current efficiency of the gap cell was achieved by use of an organic solvent, use of an anode to cathode gap distance in the range from about 0.16 centimeter to about 1.27 centimeters and use of an electrolyte pH in the range from about 5.0 to about 8.5.

What is claimed is:

1. A process for the preparation of organic hypohalites in an electrolytic cell having an electrolytic chamber containing therein an anode and a cathode separated by a gap distance, which comprises:

(a) charging an electrolyte comprised of a mixture of a halide-containing brine, and an organic alcohol in an organic solvent into said electrolytic chamber wherein said organic alcohol is selected from the group consisting of secondary alcohols, tertiary alcohols, cyclic alcohols, and mixtures thereof, (b) passing an electric current between said anode and said cathode, whereby said organic alcohol reacts with said halide to form the corresponding organic hypohalite in said electrolyte, and (c) recovering said organic hypohalite from said electrolytic chamber.

2. The process of claim 1, wherein said solvent is an essentially inert organic solvent essentially immiscible with said halide-containing brine and the weight ratio of said organic solvent to said organic alcohol is in the range from about 5:1 to about 1:1.

3. The process of claim 2, wherein said organic solvent is of the form, $$CH_xCl_y$$

where $x+y=4$ and y is an integer from 2 to 4.

4. The process of claim 3, wherein said electrolyte containing organic hypohalite is phase separated from said halide containing brine after electrolysis.

5. The process of claim 4, wherein said organic solvent is separated from said organic hypohalite, and said organic solvent is recycled to said electrolytic chamber.

6. The process of claim 5, wherein at least a portion of said electrolyte containing said organic hypohalite is removed from said electrolytic chamber.

7. The process of claim 6, wherein said gap distance between said anode and said cathode is in the range from about 0.05 centimeter to about 2.50 centimeters.

8. The process of claim 7, wherein said halide-containing brine is an aqueous solution of an alkali metal halide.

9. The process of claim 8, wherein said alkali metal halide is an alkali metal chloride.

10. The process of claim 9, wherein said halide-containing brine is a sodium chloride solution having a sodium chloride concentration in the range from about 175 to about 327 grams of sodium chloride per liter.

11. The process of claim 10, wherein the molar ratio of said halide-containing brine to said organic alcohol in said mixture is in the range from about 2:1 to about 20:1.

12. The process of claim 11, wherein the molar ratio of said brine to said organic alcohol in said mixture is in the range from about 3:1 to about 10:1.

13. The process of claim 12, wherein said anode is a titanium substrate coated with oxides of titanium and ruthenium.

14. The process of claim 7, wherein the pH of said electrolyte is in the range from about 4 to about 10.

15. The process of claim 14, wherein the pH of said electrolyte is in the range from about 5.0 to about 8.5.

16. The process of claim 14, wherein said organic alcohol is a tertiary alcohol of the form,

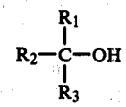

where $R_1$, $R_2$, and $R_3$ are each selected from a group consisting of alkyl groups and aryl groups having 1 to about 10 carbon atoms each.

17. The process of claim 16, wherein said organic alcohol is tertiary butyl alcohol.

18. The process of claim 17, wherein said organic solvent is $CCl_4$, the pH of said electrolyte is in the range from about 5.0 to about 8.5, and said gap distance between said anode and said cathode is in the range from about 0.05 centimeter to about 2.50 centimeters.

19. The process of claim 18, wherein said halide-containing brine is an aqueous solution of sodium chloride having a sodium chloride concentration in the range from about 175 to about 327 grams of sodium chloride per liter, wherein the molar ratio of sodium chloride brine to said organic alcohol is in the range from about 2:1 to about 20:1 and wherein said anode is a titanium substrate coated with oxides of titanium and ruthenium.

20. The process of claim 19, wherein said organic solvent is admixed with said halide-containing brine and said organic alcohol before addition to said electrolytic chamber.

21. The process of claim 19, wherein said organic solvent is admixed with said halide-containing brine and said organic alcohol after addition to said electrolytic chamber.

22. The process of claim 14, wherein said organic alcohol is a secondary alcohol of the form,

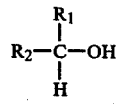

where $R_1$ and $R_2$ are each selected from a group consisting of alkyl and aryl groups having 1 to about 10 carbon atoms each.

23. The process of claim 16, wherein said organic alcohol is tertiary amyl alcohol.

24. The process of claim 16, wherein said organic alcohol is 3-methyl-3-pentanol.

25. The process of claim 16, wherein said organic alcohol is a tertiary diol of the form,

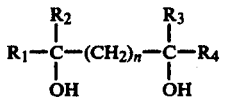

wherein n is an integer from 1 to about 10 and $R_1$, $R_2$, $R_3$, and $R_4$ are each selected from the group consisting of separate alkyl and aryl groups having 1 to about 10 carbon atoms each.

26. The process of claim 7, wherein said gap distance between said anode and said cathode is in the range from about 0.10 centimeter to about 1.25 centimeters.

27. The process of claim 26, wherein said gap distance between said anode and said cathode is in the range from about 0.15 centimeter to about 0.30 centimeter.

28. The process of claim 7, wherein said organic solvent is $CCl_4$.

29. The process of claim 7, wherein said organic solvent is admixed with said halide-containing brine and said organic alcohol before addition to said electrolytic chamber.

30. The process of claim 19, wherein said organic solvent is admixed with said halide-containing brine and said organic alcohol after addition to said electrolytic chamber.

31. The process of claim 2, wherein said organic solvent is an organic phosphate of the form,

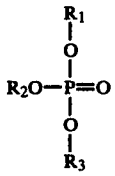

where $R_1$, $R_2$, and $R_3$ are each selected from the group consisting of alkyl and aryl groups each having 1 to about 10 carbon atoms each.

32. The process of claim 2, wherein said organic solvent is of the form, $$C_2F_xCl_y$$

where y is an integer from 2 to 6 and $x+y=6$.

33. The process of claim 2, wherein said organic solvent is of the form, $$C_2H_xCl_y$$

where y is an integer from 1 to 6 and $x+y=6$.

34. The process of claim 2, wherein said organic solvent is of the form, $$C_2H_xF_y$$

where y is an integer from 1 to 2 and $x+y=6$.

35. The process of claim 2, wherein said organic solvent is of the form, $$C_3H_xCl_y$$

where y is an integer from 1 to about 4 and $x+y=6$.

36. The process of claim 2, wherein said organic solvent is a tertiary halide of the form,

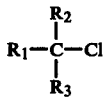

where $R_1$, $R_2$, and $R_3$ are each selected from a group consisting of alkyl groups and aryl groups each having from 1 to about 10 carbon atoms each.

37. The process of claim 36, wherein said organic solvent is tertiary butyl chloride.

38. The process of claim 2, wherein said organic solvent is selected from a group consisting of 2-chlorotoluene, 3-chlorotoluene, 4-chlorotoluene, and alpha-chlorotoluene.

39. The process of claim 2, wherein said organic solvent is selected from a group consisting of chlorobenzene, 1,2-dichlorobenzene, 1,3-dichlorobenzene, 1,2,4-trichlorobenzene, and fluorobenzene.

40. The process of claim 2, wherein said organic alcohol is cyclohexanol.

* * * * *